US005815916A

United States Patent [19]

Luc

[11] Patent Number: 5,815,916

[45] Date of Patent: Oct. 6, 1998

[54] METHOD FOR CONNECTING A CABLE TO AN ELECTRICAL CONNECTOR

[75] Inventor: Papon Luc, Montmirail, France

[73] Assignee: Axon'Cable S.A., Montmirail, France

[21] Appl. No.: 757,520

[22] Filed: Nov. 27, 1996

[30] Foreign Application Priority Data

Dec. 1, 1995 [FR] France ..... 95 14217

[51] Int. Cl.[6] ..... H05B 13/20

[52] U.S. Cl. ..... 29/828; 29/33 M; 29/857

[58] Field of Search ..... 29/828, 857, 33 M

[56] References Cited

U.S. PATENT DOCUMENTS 4,449,778 5/1984 Lane ..... 29/828

4,697,339 10/1987 Verhoeven ..... 29/828

*Primary Examiner*—Carl J. Arbes

*Attorney, Agent, or Firm*—Dvorak & Orum

[57] ABSTRACT

The invention relates to a method of connecting the conductor elements of a cable to the contacts of a connector;

the ends of the conductor are stripped, they are positioned by means of a tool, and an insulating strip is fixed onto them;

a portion of the shielding of each conductor is bared; and an insulating strip provided with a conductive strip, and the bared zones of the shielding is fixed to the conductive strip and the stripped ends of the conductors are fixed to the insulating strip.

7 Claims, 2 Drawing Sheets

METHOD FOR CONNECTING A CABLE TO AN ELECTRICAL CONNECTOR

FIELD OF THE INVENTION

The present invention relates to a method and to a device for connecting a cable constituted by a plurality of conductor elements each provided with its own shielding to an electrical connector having contacts in alignment.

More precisely, the invention relates to a connection of this type which makes such connection possible when the pitch between the contacts of the connector is very small.

BACKGROUND OF THE INVENTION

There exist numerous cases in which it is necessary for a multicoaxial cable comprising a larger number of coaxial elements of small size to be electrically connected to the conductive tracks of a printed circuit, which tracks are close together. In addition, it is often desirable to be able to disconnect the cable from the printed circuit.

This problem arises particularly, but not exclusively, in the implementation of probes, in particular echographic probes, probes for non-destructive inspection, or sonars, and more precisely when making an electrical connection for the purpose of transmitting signals between such a probe and the computer that treats the signals delivered in order to reconstitute an image. To solve such a problem, it is clear that the reliability and the quality of the connections made is of great importance for signal transmission in order to obtain a usable echographic image. In particular, this means that the way in which the cable is connected to the printed circuits of the computer will have considerable impact on the quality of the image provided by the probe.

In this application, probe manufacturers are looking for cables of ever increasing performance both electrically and dimensionally. Such 40 gauge or 42 gauge multicoaxial cables have become very common and indeed standard, which does not make the cabling of the probes any easier. There thus exists a real need to develop a method enabling such an electrical connection to be made between a multicoaxial cable and the circuits of the probe or of some other equivalent apparatus.

The cables used for this type of application are small gauge (AWG36 to AWG44, or even smaller) multicoaxial cables of controlled capacitance (commonly 50 pF/m to 100 pF/m). The best known structures for this type of cable have 48 to 304 coaxial elements or even 512 for two- and three-dimensional probes.

It will be understood that this leads to a problem of connecting a very large number of small-sized coaxial conductors and, in addition, to making a connection of high electrical quality while preferably simultaneously enabling the cable to be disconnected from the circuit.

A first solution consists in applying the coaxial conductors one by one to printed circuits. This solution requires a very great deal of handling and also gives rise to a major problem of reliability due to the cabling operations not being automated. Since all of the soldering is done manually, there is very little chance of obtaining the same quality of cabling for all of the coaxial elements. Since the method is not reproducible, the risk of error is high.

Another solution consists in using a flexible transition circuit. It consists in providing a flexible circuit with windows and soldering the ends of the coaxial elements thereto with the entire flexible circuit then being applied to the mother board via a previously-provided window. The major advantage of that solution is that the system can be disconnected.

However that solution requires the conductor elements to be subjected to two successive soldering steps, a first soldering step when the conductor elements and their shielding is soldered to the flexible transition circuit, and then a second soldering step when the conductor elements and the track relaying the shield are soldered to the printed circuit proper.

Those two successive soldering steps raise severe problems of poor quality in the final set of solder joints and therefore reduce the reliability of the electrical connection. In particular, it can be assumed that that method leads inevitably to "cold" or "dry" joints. In addition, the cable is not easily connected.

U.S. Pat. No. 5,347,711 describes a connection technique which consists in positioning pre-stripped coaxial elements on an epoxy plate in which a window and grooves for receiving the conductors have been machined. An adhesive transfer mass is initially deposited on the plate in order to hold the coaxial elements in place. At the bottom of each groove, a metal pellet is deposited and is connected to the conductor via conductive epoxy resin or by soldering. The pellets serve as locations for receiving test devices. The advantage of that device is that it is ready for being applied directly to a printed circuit because of the positioning holes, so there is no need to make use of a flexible transition circuit.

The drawback of such a method is that the device is itself complex to make, and that goes against the cost cutting required, particularly in the medical field. The epoxy plates need to be machined very accurately to begin with, the coaxial cores need to be soldered to the pellets or stuck with epoxy adhesive, each coax needs to be inserted in the recess provided for that purpose in the epoxy plate (which operation is difficult with conductors of small size), the coaxial elements need to be put into alignment on an adhesive mass that has previously been placed on the printed circuit, and an adhesive tape needs to be put into position on the coaxial element. Furthermore, the resulting electrical connection is difficult to disconnect.

OBJECTS AND SUMMARY OF THE INVENTION

A first object of the present invention is to provide a method of connecting a multicoaxial cable with a connector having contacts in alignment, which method is compatible with a small connection pitch while nevertheless ensuring great reliability which makes it possible to restrict or eliminate manual operations, thus making it possible for connection to be performed automatically in a manner that is suitable for imparting a high degree of reliability.

To achieve this object, the invention provides a method of connecting a cable constituted by a plurality of conductor elements to aligned electrical contacts of a connector, each conductor element comprising a conductor core, shielding separated from the core by a dielectric material, and an outer sheath, the method comprising the following steps:

the sheath and the shielding are removed from the end of each conductor element over a given length;

a first tool is used to position the ends of said conductor elements relative to one another to match the relative positioning of the conductor tracks;

a first insulating strip is used to fix the positioned conductor elements, said strip being fixed at least in part on portions of the conductor elements still provided with sheath;

the conductor cores at the ends of the conductor elements are stripped and at least one window is formed through the sheath of each conductor element to lay bare the shielding;

a conductive surface is formed on a second insulating strip, said surface comprising a conductive strip that extends substantially along a first edge of said second insulating strip and two conductive extensions disposed in the vicinity of the side edges of said second insulating strip and extending to a second edge of said strip, thereby obtaining a connection support;

a second tool is used to position the stripped ends of the conductor cores relative to one another as a function of the relative positioning of the conductor tracks; and the stripped and positioned ends of the conductor elements are fixed on said insulating strip of the connection support between said conductive extensions, and the bared portions of shielding of the conductor elements are electrically connected to the conductive strip of said connection support in such a manner that the stripped end portions of the conductor elements are substantially in alignment along said second edge of the connection support.

It will be understood that the method of the invention provides a cable in which the ends of the coaxial elements are accurately positioned relative to one another as a function of the pitch that exists between the contacts of the connector and that they are mounted on a pluggable mechanical support. The ends of the coaxial elements have respective stripped core portions whose tips are in alignment along the edge of the support. It would also be understood that to obtain this result, only one soldering operation is required. The assembly can easily be plugged into the connector fixed on the printed circuit.

It will also be understood that this method makes highly accurate positioning of the various coaxial elements of the cable possible and serves to hold them accurately in position.

Preferably, after the conductor cores have been stripped, they are pre-tinned and rolled to give them a substantially rectangular right section. This additional operation makes it possible to reduce contact resistance between the stripped ends of the conductors and the aligned contacts of the connector.

The invention also provides a device for connecting a cable constituted by a plurality of electrical conductors provided with respective shielding to an electrical connector having contacts in alignment, the device comprising:

a connection support constituted by a substantially plane insulating strip of sufficient mechanical strength, of substantially rectangular shape having a leading edge for penetrating into the connector, a trailing edge, and two side edges, and by a conductive surface formed on said insulating strip and presenting a conductive strip disposed in the vicinity of the trailing edge and two conductive extensions extending substantially along the side edges of the insulating strip, the stripped ends of the conductor elements being fixed to said insulating strip between the extensions at a predetermined pitch so that the stripped end portions thereof are substantially in alignment along the leading edge, the partially bared shielding being fixed to said conducive strip; and a retaining insulating strip fixed on the electrical conductors in their portions still having respective sheaths, said fixing strip extending substantially perpendicularly to said electrical conductors.

BRIEF DESCRIPTION OF THE DRAWINGS

Other characteristics and advantages of the invention appear more clearly on reading the following description of various implementations of the method given as non-limiting examples. The description refers to the accompanying figures, in which.

MORE DETAILED DESCRIPTION

With reference initially to FIGS. 1*a* to 1*d,* there follows a detailed description of a preferred implementation of the method of connecting the multicoaxial cable to an electrical connector.

In a first step shown in FIGS. 1*a* to 1*d,* the ends of the coaxial elements of the cable are appropriately stripped and mechanically linked to hold them at a pitch or spacing that corresponds to that of the electrical contacts of the connector to which the cable is to be connected.

Initially, the end of each coaxial element is partially stripped. More precisely, in FIG. 1*a,* there can be seen a coaxial element 10 with its outer sheath 12. The end of the coaxial element is stripped over a length L1 so as to remove both the outer sheath and the shielding. Over the length L1, given reference 14, there remains only the dielectric and the conductive core. It is preferable also to provide a pre-stripping nick 15 through the dielectric.

Figure 1A:
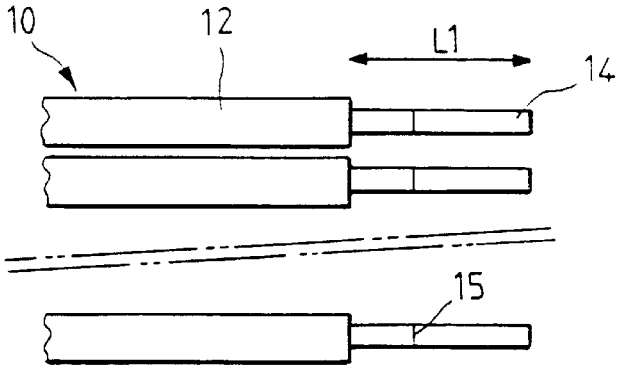
FIGS. 1*a* to 1*d* are plan views showing the various steps whereby the ends of the coaxial elements of the cable are linked together and positioned in a first implementation of the method.
Figure 1B:
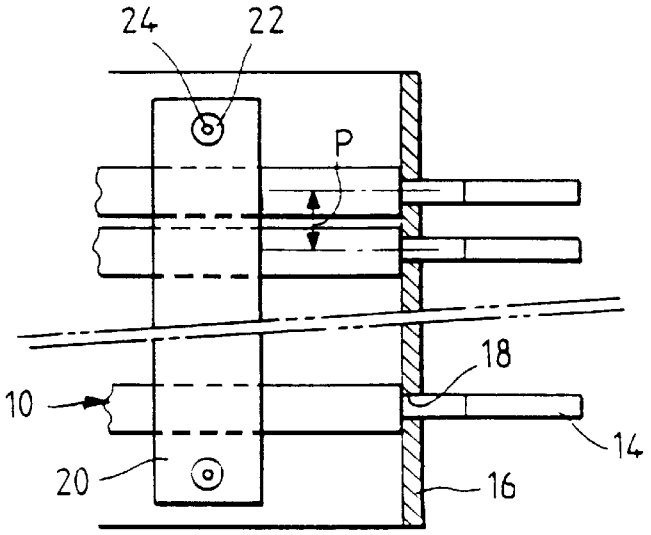

In the following step, shown in FIG. 1*b,* the various coaxial elements 10 whose ends 14 have been stripped are positioned flat next to one another at a determined pitch p by using a positioning tool, e.g. comprising a plate 16 having holes 18 at the desired pitch. The pitch p corresponds to the pitch of the aligned electrical contacts of the connector. The ends 14 of the coaxial elements pass through the holes 18 with the remaining portion of the sheath coming into abutment against the plate 16. This achieves correct flat positioning of the coaxial elements. A strip or tape 20 of material that becomes adhesive when heated is fixed to the portions of the coaxial elements still having respective sheaths. This material is preferably a hot melt adhesive tape having a thickness of 230 microns and of sufficient mechanical strength to maintain the spacing of the coaxial elements. Each end of the tape has a positioning hole 22 which is made to coincide with a positioning stud 24 belonging to the first positioning tool 16.

Figure 1C:
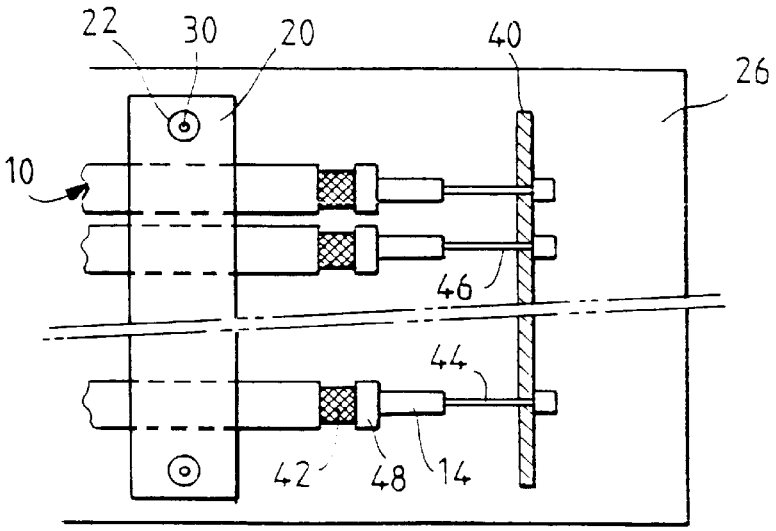
Figure 1D:
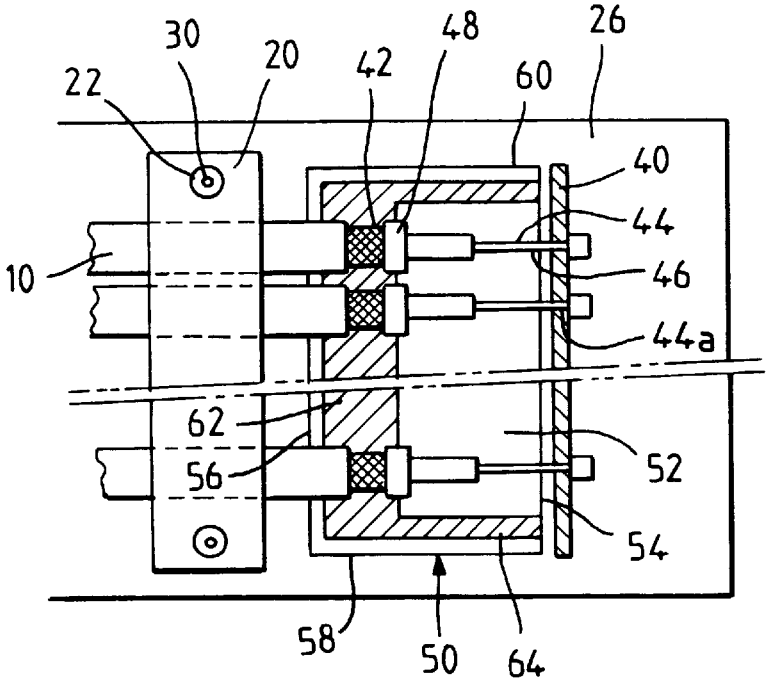

In a following step, shown in FIG. 1*c,* a laser tool (not shown) is used to bare a portion of the shielding 42 of each coaxial element 10 and then to finish off stripping the ends of the elements 10. For this purpose, the packet of coaxial elements 10 together with the fixing tape 20 is placed on a second tool 26 for stripping, combing and positioning. Relative positioning between the packet to be stripped and the tool is ensured by co-operation between the positioning hole 22 and a corresponding reference stud 30 on the tool. The tool combs and strips the dielectrics by means of a rake, with the stripping performed in this way leaving an end portion 44 of each conductor core 46 that is likewise stripped. A ring 48 of sheath is preferably allowed to remain between the bared portion 42 of shielding and the dielectric 14 so as to prevent the shielding splaying out. When the rake 40 of the tool 26 reaches the end of its stroke, as shown in FIG. 1*d,* the ends 44 of the conductor cores of the coaxial elements are accurately positioned thereby.

Contact resistance between the ends 44 of the conductor cores and the aligned contacts of the connector 72 may, where appropriate, be reduced by pre-tinning the ends or dipping them in a bath and then locally crushing them in order to obtain a section in the zone 44 that is substantially rectangular.

A connection support 50 is put into position relative to the tool 26. The support includes an insulating strip 52 of heat bondable material that is generally rectangular in shape. This strip 52 has a leading edge 54, a trailing edge 56, and two side edges 58 and 60, the length of the leading edge 54 of the strip 52 naturally corresponding exactly to the geometrical characteristics of the connector. It has sufficient mechanical strength to enable it to be plugged into a connector having aligned contacts. The support 50 also has a conductive surface constituted by a conductive strip 62 extending close to the trailing edge 56 of the insulating strip 52 and by two extensions 64 and 66 of the strip 62 that extend close to the side edges 58 and 60 and terminate at the leading edge 54.

The connection support 50 is positioned in such a manner that the stripped portions of shielding 42 are in register with the conductive strip 62 and the conductive extensions 64 and 66 extend parallel to the stripped ends 44 of the conductor elements. The stripped ends are disposed between the two extensions.

The conductive surface 62, 64, 66 can constitute a copper part that is precut and etched, e.g. having a thickness of 10 microns, and it is previously fixed to the hot melt strip 50. It could equally be obtained by metallizing one of the faces of the hot melt strip and etching the metallization to give it an appropriate shape.

Once this positioning has been achieved, the ends 44 of the conductor elements are stuck to the insulating strip 52 and the bared portions 42 of the shielding are soldered to the conductive strip 62. This soldering is preferably performed by means of a "hot bar" soldering device that enables all of the shielding to be soldered automatically and simultaneously to the conductive strip 62. This operation is highly repeatable and very reliable.

After these operations, it suffices to cut off the tip portions 44*a* of the ends 44 of the conductors to obtain an assembly that can be plugged into a connector having electrical contacts in alignment and that is of sufficient mechanical strength because of the strips 20 and 52. This cutting operation is performed flush with the leading edge 54 of the insulating strip 52 so that the ends of the electrical conductors are in alignment flush with the edge 54.

Figure 2:
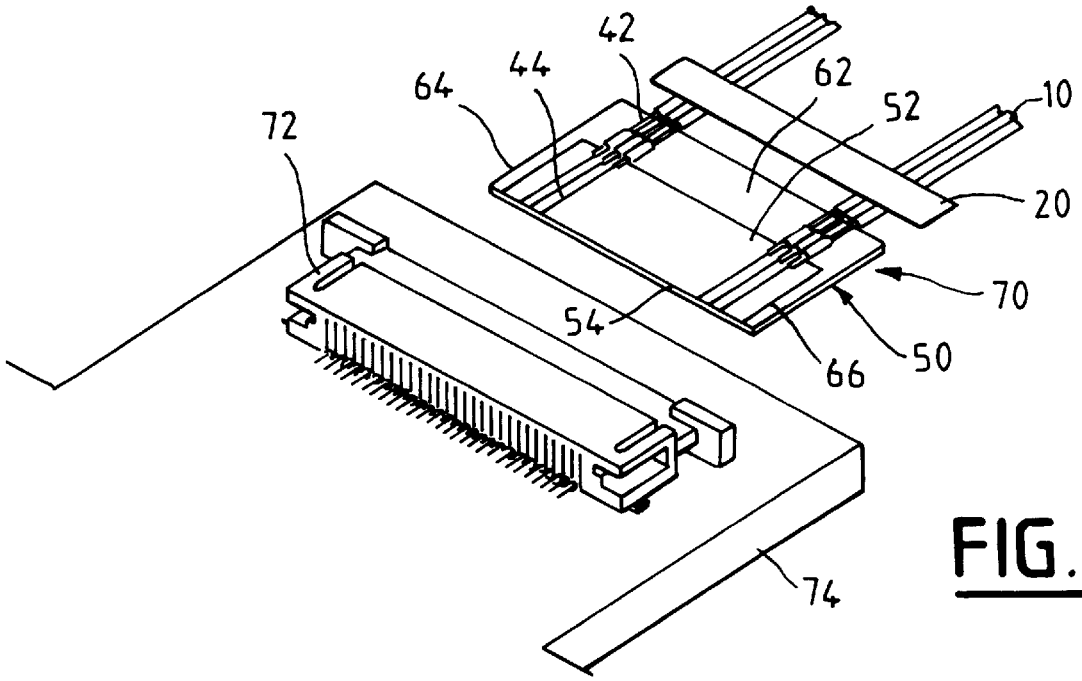
FIG. 2 is a perspective view showing how the cable is connected to the connector of the printed circuit.

FIG. 2 shows the connector device 70 as obtained in this way being presented to a connector 72 having contacts in alignment and mounted on a printed circuit 74.

The connector 72 is preferably a zero insertion force (ZIF) connector. It may be a Molex series 52435, an AMP series FPC, or a JAE series JL-FRP type connector. Under such circumstances, the pitch of the coaxial elements is 0.5 mm. The invention can be adapted to ZIF connectors that are available with the following millimeter pitches: 1.27, 1.25, 1.0, 0.8, 0.635, and 0.5, or to connectors under development at a pitch of 0.3 mm, for example.

What is claimed is:

1. A method of connecting a cable constituted by a plurality of conductor elements to aligned electrical contacts of a connector, each conductor element comprising a conductor core, shielding separated from the core by a dielectric material, and an outer sheath, the method comprising the steps of:

removing the sheath and the shielding from the end of each conductor element over a given length;

using a first tool to position the ends of said conductor elements relative to one another to match the relative positioning of the conductor tracks;

using a first insulating strip to fix the positioned conductor elements, said strip being fixed at least in part on portions of the conductor elements still provided with sheath;

stripping the conductor cores at the ends of the conductor elements and forming at least one window through the sheath of each conductor element to lay bare the shielding;

forming a conductive surface on a second insulating strip, said surface comprising a conductive strip that extends substantially along a first edge of said second insulating strip and two conductive extensions disposed in the vicinity of the side edges of said second insulating strip and extending to a second edge of said strip, thereby obtaining a connection support;

using a second tool to position the stripped ends of the conductor cores relative to one another as a function of the relative positioning of the conductor tracks; and fixing the stripped and positioned ends of the conductor elements on said insulating strip of the connection support between said conductive extensions, and electrically connecting the bared portions of shielding of the conductor elements to the conductive strip of said connection support in such a manner that the stripped end portions of the conductor elements are substantially in alignment along said second edge of the connection support.

2. A method of connection according to claim 1, wherein, after having stripped the conductive cores they are pretinned and rolled to give them a right section that is substantially rectangular.

3. A method according to claim 1, wherein said first strip is provided with position-marking holes for the second positioning tool.

4. A method according to claim 3, wherein said second strip has sufficient mechanical strength to enable it to be engaged in said electrical connector.

5. A method according to claim 4, wherein the length of the second edge of the second insulating strip corresponds to the geometrical dimensions of the connector.

6. A method according to claim 1, wherein said conductive surface consists in a piece of metal fixed on said second insulating strip.

7. A method according to claim 1, wherein said conductive surface is obtained by metallizing said second insulating strip.

* * * * *